US006043801A

United States Patent [19]

Bassetti

[11] Patent Number: 6,043,801

[45] Date of Patent: Mar. 28, 2000

[54] DISPLAY SYSTEM WITH HIGHLY LINEAR, FLICKER-FREE GRAY SCALES USING HIGH FRAMECOUNTS

[75] Inventor: Chester F. Bassetti, Pleasanton, Calif.

[73] Assignee: NeoMagic Corporation, Santa Clara, Calif.

[21] Appl. No.: 08/958,817

[22] Filed: Oct. 28, 1997

Related U.S. Application Data

[63] Continuation of application No. 08/643,275, May 8, 1996, Pat. No. 5,805,126, which is a continuation of application No. 08/238,832, May 5, 1994, abandoned.

[51] Int. Cl.[7] ..... G09G 3/36

[52] U.S. Cl. ..... 345/89; 345/147

[58] Field of Search ..... 345/94, 147, 148, 345/89, 63, 58

[56] References Cited

U.S. PATENT DOCUMENTS

| | | | |
|---|---|---|---|
| 5,111,194 | 5/1992 | Oneda | 345/147 |
| 5,313,224 | 5/1994 | Singhal et al. | 345/148 |
| 5,479,188 | 12/1995 | Moriyama | 345/147 |
| 5,714,974 | 2/1998 | Liu | 345/147 |
| 5,748,163 | 5/1998 | Han | 345/148 |
| 5,774,101 | 6/1998 | Hirai et al. | 345/148 |

*Primary Examiner*—Amare Mengistu

*Attorney, Agent, or Firm*—Townsend and Townsend and Crew LLP

[57] ABSTRACT

A circuit system for generating phase values and frame counts, particularly adapted for liquid crystal displays is described. The phase values are generated by 8×8 matrices, which are formed, in turn, from smaller matrices. The circuit system handles a large number of gray scale levels, 64, which are highly linear in their shading with a reduced possibility of display flicker. Furthermore, the frame count generating circuitry are arranged with respect to the phase values generating circuitry for a highly integrated implementation for color displays.

41 Claims, 12 Drawing Sheets

| | ----FRAME---- | | |
|---|---|---|---|
| | 0 | 1 | 2 |
| PHASE-1 | 1 | 0 | 0 |
| PHASE-2 | 0 | 1 | 0 |
| PHASE-3 | 0 | 0 | 1 |

*FIG. 1*
Prior Art

| FRAMES | PHASES | # LINEAR SHADES | # UNIQUE SHADES | UNIQUE VALUES |
|---|---|---|---|---|
| 1 | 1 | 2 | 2 | 0,100 |
| 2 | 2 | 3 | 1 | 50 |
| 3 | 3 | 4 | 2 | 33,66 |
| 4 | 4 | 5 | 2 | 25,75 |
| 5 | 5 | 6 | 4 | 20,40,60,80 |
| 6 | 6 | 7 | 2 | 16.7,83.3 |
| 7 | 7 | 8 | 6 | 14,28,42,57,71,85 |
| 8 | 8 | 9 | 4 | 13,38,63,87 |
| Total No. of Shades = | | | 23 | |

*FIG. 2*
Prior Art

| | ----------FRAME--------- | | | |
|---|---|---|---|---|
| PHASE | 0 | 1 | 2 | 3 |
| 0 | **on** | off | off | off |
| 1 | off | **on** | off | off |
| 2 | off | off | **on** | off |
| 3 | off | off | off | **on** |

*FIG. 3*
Prior Art

| | | | |
|---|---|---|---|
| 0 | 12 | 7 | 11 |
| 4 | 8 | 3 | 15 |
| 9 | 5 | 14 | 2 |
| 13 | 1 | 10 | 6 |

FIG. 4

| QUADRANT | MULT | | | ADD | | | ROT-Y | | | ROT-X | | |
|---|---|---|---|---|---|---|---|---|---|---|---|---|
| | A | B | C | A | B | C | A | B | C | A | B | C |
| UPPER LEFT | 1 | 4 | 4 | 0 | 0 | 0 | 0 | 0 | 0 | 0 | 0 | 0 |
| UPPER RIGHT | 1 | 4 | 4 | 48 | 3 | 3 | 3 | 3 | 1 | 0 | 0 | 1 |
| LOWER LEFT | 1 | 4 | 4 | 32 | 2 | 1 | 0 | 0 | 3 | 3 | 3 | 3 |
| LOWER RIGHT | 1 | 4 | 4 | 16 | 1 | 2 | 0 | 0 | 2 | 0 | 0 | 2 |

FIG. 5

| | | | | | | | |
|---|---|---|---|---|---|---|---|
| 0 | 12 | 7 | 11 | 61 | 49 | 58 | 54 |
| 4 | 8 | 3 | 15 | 48 | 60 | 55 | 59 |
| 9 | 5 | 14 | 2 | 52 | 56 | 51 | 63 |
| 13 | 1 | 10 | 6 | 57 | 53 | 62 | 50 |
| 43 | 32 | 44 | 39 | 16 | 28 | 23 | 27 |
| 47 | 36 | 40 | 35 | 20 | 24 | 19 | 31 |
| 34 | 41 | 37 | 46 | 25 | 21 | 30 | 18 |
| 38 | 45 | 33 | 42 | 29 | 17 | 26 | 22 |

8x8 MATRIX- A

FIG. 6A

| | | | | | | | |
|---|---|---|---|---|---|---|---|
| 0 | 48 | 28 | 44 | 55 | 7 | 43 | 27 |
| 16 | 32 | 12 | 60 | 3 | 51 | 31 | 47 |
| 36 | 20 | 56 | 8 | 19 | 35 | 15 | 63 |
| 52 | 4 | 40 | 24 | 39 | 23 | 59 | 11 |
| 46 | 2 | 50 | 30 | 1 | 49 | 29 | 45 |
| 62 | 18 | 34 | 14 | 17 | 33 | 13 | 61 |
| 10 | 38 | 22 | 58 | 37 | 21 | 57 | 9 |
| 26 | 54 | 6 | 42 | 53 | 5 | 41 | 25 |

8x8 MATRIX- B

FIG. 6B

| | | | | | | | |
|---|---|---|---|---|---|---|---|
| 0 | 48 | 28 | 44 | 35 | 15 | 63 | 19 |
| 16 | 32 | 12 | 60 | 23 | 59 | 11 | 39 |
| 36 | 20 | 56 | 8 | 7 | 43 | 27 | 55 |
| 52 | 4 | 40 | 24 | 51 | 31 | 47 | 3 |
| 25 | 53 | 5 | 41 | 58 | 10 | 38 | 22 |
| 45 | 1 | 49 | 29 | 42 | 26 | 54 | 6 |
| 61 | 17 | 33 | 13 | 30 | 46 | 2 | 50 |
| 9 | 37 | 21 | 57 | 14 | 62 | 18 | 3 |

8x8 MATRIX- C

FIG. 6C

| | | | | | | | |
|---|---|---|---|---|---|---|---|
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0 |
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0 |

FIG. 7

| GRAYSCALE | PATTERN | MULTIPLIER |
|---|---|---|
| 0/64 | ANY PATTERN | ANY MULTIPLIER |
| 1/64 | A | 3 |
| 2/64 | A | 2 |
| 3/64 | C | 5 |
| 4/64 | A | 6 |
| 5/64 | C | 2 |
| 6/64 | B | 9 |
| 7/64 | B | 6 |
| 8/64 | A | 11 |
| 9/64 | C | 9 |
| 10/64 | B | 15 |
| 11/64 | B | 2 |
| 12/64 | A | 5 |
| 13/64 | B | 2 |
| 14/64 | B | 5 |
| 15/64 | A | 5 |
| 16/64 | A | 2 |
| 17/64 | A | 3 |
| 18/64 | A | 3 |
| 19/64 | B | 14 |
| 20/64 | A | 2 |
| 21/64 | B | 6 |
| 22/64 | C | 15 |
| 23/64 | B | 3 |
| 24/64 | A | 1 |
| 25/64 | B | 7 |
| 26/64 | A | 2 |
| 27/64 | C | 15 |
| 28/64 | A | 5 |
| 29/64 | B | 1 |
| 30/64 | A | 6 |
| 31/64 | B | 15 |
| 32/64 | D | 1 |

*FIG. 9* string gs0 '(/stg5*/stg4*/stg3*/stg2*/stg1*/stg0)'

EQUATIONS

```
mgs0 = /stg5 * /gs0  * /(stg0)
     + stg5 * /stg0
mgs1 = /stg5 * /stg1 *  (stg0)
     + /stg5 *  stg1 * /(stg0)
     + stg5 * /stg1
mgs2 = /stg5 * /stg2 *  (stg0*stg1)
     + /stg5 *  stg2 * /(stg0*stg1)
     + stg5 * /stg2
mgs3 = /stg5 * /stg3 *  (stg0*stg1*stg2)
     + /stg5 *  stg3 * /(stg0*stg1*stg2)
     + stg5 * /stg3
mgs4 = /stg5 * /stg4 *  (stg0*stg1*stg2*stg3)
     + /stg5 *  stg4 * /(stg0*stg1*stg2*stg3)
     + stg5 * /stg4
mgs5 = /stg5 * /stg5 *  (stg0*stg1*stg2*stg3*stg4)
     + /stg5 *  stg5 * /(stg0*stg1*stg2*stg3*stg4)
     + stg5 * /stg5
mgs6 = stg5
```

DEFINITIONS:

| | |
|---|---|
| stg(5:0) | = image data input (requested grayscale) |
| mgs(5:0) | =Mapped grayscale output |
| mgs6 | = INVERT-SHADE command bit |

Grayscale Mapper Block

*FIG. 10*

```
string gs1  '(/mgs5*/mgs4*/mgs3*/mgs2*/mgs1* mgs0)'
string gs2  '(/mgs5*/mgs4*/mgs3*/mgs2* mgs1*/mgs0)'
string gs3  '(/mgs5*/mgs4*/mgs3*/mgs2* mgs1* mgs0)'
string gs4  '(/mgs5*/mgs4*/mgs3* mgs2*/mgs1*/mgs0)'
string gs5  '(/mgs5*/mgs4*/mgs3* mgs2*/mgs1* mgs0)'
string gs6  '(/mgs5*/mgs4*/mgs3* mgs2* mgs1*/mgs0)'
string gs7  '(/mgs5*/mgs4*/mgs3* mgs2* mgs1* mgs0)'
string gs8  '(/mgs5*/mgs4* mgs3*/mgs2*/mgs1*/mgs0)'
string gs9  '(/mgs5*/mgs4* mgs3*/mgs2*/mgs1* mgs0)'
string gs10 '(/mgs5*/mgs4* mgs3*/mgs2* mgs1*/mgs0)'
string gs11 '(/mgs5*/mgs4* mgs3*/mgs2* mgs1* mgs0)'
string gs12 '(/mgs5*/mgs4* mgs3* mgs2*/mgs1*/mgs0)'
string gs13 '(/mgs5*/mgs4* mgs3* mgs2*/mgs1* mgs0)'
string gs14 '(/mgs5*/mgs4* mgs3* mgs2* mgs1*/mgs0)'
string gs15 '(/mgs5*/mgs4* mgs3* mgs2* mgs1* mgs0)'
string gs16 '(/mgs5* mgs4*/mgs3*/mgs2*/mgs1*/mgs0)'
string gs17 '(/mgs5* mgs4*/mgs3*/mgs2*/mgs1* mgs0)'
string gs18 '(/mgs5* mgs4*/mgs3*/mgs2* mgs1*/mgs0)'
string gs19 '(/mgs5* mgs4*/mgs3*/mgs2* mgs1* mgs0)'
string gs20 '(/mgs5* mgs4*/mgs3* mgs2*/mgs1*/mgs0)'
string gs21 '(/mgs5* mgs4*/mgs3* mgs2*/mgs1* mgs0)'
string gs22 '(/mgs5* mgs4*/mgs3* mgs2* mgs1*/mgs0)'
string gs23 '(/mgs5* mgs4*/mgs3* mgs2* mgs1* mgs0)'
string gs24 '(/mgs5* mgs4* mgs3*/mgs2*/mgs1*/mgs0)'
string gs25 '(/mgs5* mgs4* mgs3*/mgs2*/mgs1* mgs0)'
string gs26 '(/mgs5* mgs4* mgs3*/mgs2* mgs1*/mgs0)'
string gs27 '(/mgs5* mgs4* mgs3*/mgs2* mgs1* mgs0)'
string gs28 '(/mgs5* mgs4* mgs3* mgs2*/mgs1*/mgs0)'
string gs29 '(/mgs5* mgs4* mgs3* mgs2*/mgs1* mgs0)'
string gs30 '(/mgs5* mgs4* mgs3* mgs2* mgs1*/mgs0)'
string gs31 '(/mgs5* mgs4* mgs3* mgs2* mgs1* mgs0)'
string gs32 '( mgs5*/mgs4*/mgs3*/mgs2*/mgs1*/mgs0)'
```

EQUATIONS

```
sel0  = gs6+gs7+gs10+gs11+gs13+gs14+gs19+gs21+gs23+gs25+gs29+gs31+gs32
sel1  = gs3+gs5+gs9+gs22+gs27+gs32
```

DEFINITIONS:

| | |
|---|---|
| mgs(5:0) | =Mapped Grayscales |
| sel(1:0) | =Selection bits for Matrix Mutiplexer |

Matrix Decoder

*FIG. 11*

```
string g1  '(/mgs5*/mgs4*/mgs3*/mgs2*/mgs1* mgs0)'
string g2  '(/mgs5*/mgs4*/mgs3*/mgs2* mgs1*/mgs0)'
string g3  '(/mgs5*/mgs4*/mgs3*/mgs2* mgs1* mgs0)'
string g4  '(/mgs5*/mgs4*/mgs3* mgs2*/mgs1*/mgs0)'
string g5  '(/mgs5*/mgs4*/mgs3* mgs2*/mgs1* mgs0)'
string g6  '(/mgs5*/mgs4*/mgs3* mgs2* mgs1*/mgs0)'
string g7  '(/mgs5*/mgs4*/mgs3* mgs2* mgs1* mgs0)'
string g8  '(/mgs5*/mgs4* mgs3*/mgs2*/mgs1*/mgs0)'
string g9  '(/mgs5*/mgs4* mgs3*/mgs2*/mgs1* mgs0)'
string g10 '(/mgs5*/mgs4* mgs3*/mgs2* mgs1*/mgs0)'
string g11 '(/mgs5*/mgs4* mgs3*/mgs2* mgs1* mgs0)'
string g12 '(/mgs5*/mgs4* mgs3* mgs2*/mgs1*/mgs0)'
string g13 '(/mgs5*/mgs4* mgs3* mgs2*/mgs1* mgs0)'
string g14 '(/mgs5*/mgs4* mgs3* mgs2* mgs1*/mgs0)'
string g15 '(/mgs5*/mgs4* mgs3* mgs2* mgs1* mgs0)'
string g16 '(/mgs5* mgs4*/mgs3*/mgs2*/mgs1*/mgs0)'
string g17 '(/mgs5* mgs4*/mgs3*/mgs2*/mgs1* mgs0)'
string g18 '(/mgs5* mgs4*/mgs3*/mgs2* mgs1*/mgs0)'
string g19 '(/mgs5* mgs4*/mgs3*/mgs2* mgs1* mgs0)'
string g20 '(/mgs5* mgs4*/mgs3* mgs2*/mgs1*/mgs0)'
string g21 '(/mgs5* mgs4*/mgs3* mgs2*/mgs1* mgs0)'
string g22 '(/mgs5* mgs4*/mgs3* mgs2* mgs1*/mgs0)'
string g23 '(/mgs5* mgs4*/mgs3* mgs2* mgs1* mgs0)'
string g24 '(/mgs5* mgs4* mgs3*/mgs2*/mgs1*/mgs0)'
string g25 '(/mgs5* mgs4* mgs3*/mgs2*/mgs1* mgs0)'
string g26 '(/mgs5* mgs4* mgs3*/mgs2* mgs1*/mgs0)'
string g27 '(/mgs5* mgs4* mgs3*/mgs2* mgs1* mgs0)'
string g28 '(/mgs5* mgs4* mgs3* mgs2*/mgs1*/mgs0)'
string g29 '(/mgs5* mgs4* mgs3* mgs2*/mgs1* mgs0)'
string g30 '(/mgs5* mgs4* mgs3* mgs2* mgs1*/mgs0)'
string g31 '(/mgs5* mgs4* mgs3* mgs2* mgs1* mgs0)'
string g32 '( mgs5*/mgs4*/mgs3*/mgs2*/mgs1*/mgs0)'
```

Multiplier Decoder

*FIG. 12a*

```
string m1  ' g24+g29+g32'
string m2  ' g2+g5+g11+g13+g16+g20+g26'
string m3  ' g1+g17+g18+g23'
string m5  ' g3+g12+g14+g15+g28'
string m6  ' g4+g7+g21+g30'
string m7  ' g25'
string m9  ' g6+g9'
string m11 ' g8'
string m14 ' g19'
string m15 ' g10+g22+g27+g31'
```

EQUATIONS

```
mul0 := m1+     m3+m5+     m7+m9+   m11+      m15
mul1 :=     m2+m3+     m6+m7+       m11+m14+m15
mul2 :=            m5+m6+m7+              m14+m15
mul3 :=                       m9+   m11+m14+m15
```

DEFINITIONS:

mgs(5:0) = Mapped grayscales mul(3:0) = MULTIPLY value (used by MULTIPLIER to multiply the output of the PHASE MUTIPLEXER)

Multiplier Decoder

*FIG. 12B*

```
012345678901234567890123456789012345678901234567890123456789012345678901234567890123
000000000000000000000000000000000000000000000000000000000000000000000000000000000 gs 0/64
000000000000000000000000000000100000000000000000000000000000000000000000000000000 gs 1/64
000000000000000100000000000000000000000000000000000100000000000000000000000000000 gs 2/64
000000000010000000000000000000010000000000000000000000010000000000000000000000000 gs 3/64
000000010000000000000000100000000000000010000000000000000100000000000000000000000 gs 4/64
000000100000000000000100000000000000010000000000000001000000000000000100000000000 gs 5/64
000001000000000010000000000010000000000010000000000100000000000010000000000000000 gs 6/64
000010000000001000000000010000000000100000000001000000000010000000000100000000000 gs 7/64
000100000000100000000100000000100000000010000000010000000001000000000100000000000 gs 8/64
000100000010000000100000001000000010000000100000001000000010000000010000000000000 gs 9/64
000100000100000010000000100000010000000100000001000000010000000100000001000000000 gs 10/64
001000001000000100000010000001000000100000010000001000000100000010000001000000000 gs 11/64
001000010000010000100000100000100000100000100000100000100000100000100000100000000 gs 12/64
001000010000100001000010000100010000100001000010000100001000010000100000100000000 gs 13/64
001000100001000100001000010001000010001000010000100001000010000100001000000000000 gs 14/64
001000100010001000010001000100010000100010001000010000100010001000000000000000000 gs 15/64
010001000100010001000100010001000100010001000100010001000100010000000000000000000 gs 16/64
010001000100010010001000100010010001000100010001000100100010001000000000000000000 gs 17/64
010001001000100100010001001000100100010010001001000100010001000000000000000000000 gs 18/64
010001001001000100100100010010010001001000100100100010010001000000000000000000000 gs 19/64
010010010001001001001001000100100100100100010010010010010001000000000000000000000 gs 20/64
010010010010010010010010010010010001001001001001001001001001000000000000000000000 gs 21/64
010010010010010100100100100100100100100100100100101001001001000000000000000000000 gs 22/64
010010100100100100101001001001010010010010010100100100100100101000000000000000000 gs 23/64
010100100101001001010010010100100101001001010010010100100100101000000000000000000 gs 24/64
010100101001001010010100101001010010010100101001010010010100101000000000000000000 gs 25/64
010100101001010100101001010010100101001010010100101001010010100000000000000000000 gs 26/64
010101001010010101001010100101010010100101010010101001010010100000000000000000000 gs 27/64
010101010010101001010101001010100101010010101001010101001010100000000000000000000 gs 28/64
010101010100101010101001010101010010101010010101010100101010100000000000000000000 gs 29/64
010101010101010100101010101010100101010101010101001010101010100000000000000000000 gs 30/64
010101010101010101010101010101010010101010101010101010101010100000000000000000000 gs 31/64
101010101010101010101010101010101010101010101010101010101010101000000000000000000 gs 32/64
```

*FIG. 13*

DISPLAY SYSTEM WITH HIGHLY LINEAR, FLICKER-FREE GRAY SCALES USING HIGH FRAMECOUNTS

This is a continuation of application Ser. No. 08/643,275 filed May 8, 1996, now U.S. Pat. No. 5,805,126 issued Sep. 8, 1998, which is a continuation of application Ser. No. 08/238,832 filed May 5, 1994, now abandoned, and the disclosure of which is incorporated by reference.

BACKGROUND OF THE INVENTION

The present invention is related to computer display systems and, more particularly, to liquid crystal display systems for portable computers.

Humans can sometimes perceive images which are technically different images to be essentially the same. In the case of brightness intensity, it is known that the human eye has a logarithmic response (brightness must increase exponentially to produce what the eye perceives as linearly increasing intensity). In addition, due to a finite response time, the human eye integrates an image over time (temporal integration). The human eye is also limited in terms of resolution and this cause an image to be integrated spatially (spatial integration).

These factors of human perception must be properly coordinated in order to yield a display system with good visual display quality.

One of the earliest display technologies to employ gray scaling, creation of levels of brightness, is the cathode ray tube (CRT). Gray scaling on a CRT is achieved through the use of analog voltage levels of the input signal. The signal is then converted to a control voltage for the grid electrode which, in turn, controls the electron beam intensity as the beam sweeps across the CRT phosphor. A higher electron beam intensity corresponds to a brighter image on the CRT phosphor. The analog voltage levels can, in theory, be infinitely small and thus, the number of gray scales which can be produced are infinite.

Although the analog method of producing gray scales on the CRT is perhaps the most commonly used method, especially for television, and is generally regarded optimum, other gray scale techniques, spatial and temporal, have also been employed on CRTs to meet cost and various other design goals with various levels of display quality.

A major goal of any display system for producing gray shades should be that the number of gray shades be large (64 to 256), the gray shades be linear, the gray shades be stable (no flicker or jitter), the gray shades be smooth (non-grainy), and the system be cost-efficient.

Over the past years, other types of display technologies have emerged. Many of these technologies are multiplexed displays. These types of displays have typically two electrodes to apply stimulus to the individual display elements (pixels). In order to reduce the number of display connections, the electrodes are arranged in groups of rows and columns. With this arrangement, it is possible to scan these types of displays 1-pixel at a time, similar to a CRT. Given this type of scanning, the drive period for a given pixel is inversely proportional to the total number of display pixels in the display. For many of these multiplexed displays, the drive period, or duty cycle, (time driven/total time) determines how well the display is able to perform in terms of brightness and the contrast ratio (contrast ratio= on-brightness/off-brightness).

A common display used in portable computers has 640 vertical columns and 480 horizontal rows. Since all columns are driven simultaneously, the duty cycle is usually referred to as 1/480. It is also possible for a 480 line display to have a 1/240 duty cycle. These displays are referred to as "dual scan" because the display column electrodes are disconnected in the middle of the display and a separate set of column drivers are required to drive the top and bottom portions of the display. These dual scan displays have become popular because the display characteristics, i.e., the contrast ratio, are better.

With many of the display technologies, a more efficient way to drive these displays is to energize a group of pixel elements at the same time. One common grouping is an entire row of pixels at the same time. This usually means that the data for the individual column electrodes must be gathered and stored such that all columns can be driven simultaneously for the given row period.

The analog gray scale is well suited in terms of cost and display quality for some display types, such as the CRT. However, the analog technique is not possible with some new display technologies because the display elements are simple on/off devices, such as AC plasma displays, and not practical with some others due to cost or design complexities.

Super-Twisted-Nematic (STN) liquid crystal displays (LCDs) have provided the proper sharp threshold voltages needed for high duty cycle displays. Over the past decade these displays have been used extensively in portable, battery-operated computers. These portable computers (laptop, notebook, sub-notebook, palmtop, etc.) have enjoyed increasing popularity. The inherent low power capability of the LCD has enabled these products to achieve light weight and low power.

Another type of LCD display is the active matrix display, which has even better display characteristics than STN displays. Analog gray scales are possible on these types of display panels, but the cost of the display technology and the drive electronics required by these displays have limited these panels to the high-end niche of the portable computer market.

STN LCDs in particular do not lend themselves well to analog drive techniques because the voltage difference between on and off states is very small and, thus, difficult to control. Spatial and temporal techniques are used to control gray scales on these type of displays.

Spatial techniques have been employed for years in the printing industry. This technique is called "halftoning". In this technique "dots" of various sizes are used. Large black dots (on a whitepaper) make the image in that area darker and smaller black dots make the image in those areas lighter. When viewing these images from "normal" reading distances, the dots are not noticeable and the image appears to be made from solid shades. The human visual systems limitation in spatial resolution effectively makes this technique possible.

Another shading technique is "dithering". Raster printers do not have the ability to vary the size of an individual dot, so groups of dots are used. In dark areas of the image a higher proportion of black dots is used, while in the lighter image areas a lower proportion of black dots is used. Even with the relatively high dot density of today's raster printers 300–600 DPI (dots per inch), various dithering techniques have been employed to make these shades appear smoother, i.e., less grainy. Two popular spatial techniques in this field have been ordered dithering and error diffusion.

Early systems which employed an LCD display have applied spatial techniques to produce gray scales. However, even when complex dithering techniques were employed, the pictures still appeared very grainy. This was due to the much lower DPI densities of typical computer displays (50–100 DPI versus 300–600 DPI for printers).

Temporal techniques are also employed in many displays including LCDs. This basic technique controls the proportion of time that a pixel is on and off. This technique takes advantage of the time integration of the human eye. Indeed, many room light dimmer controllers use this technique to control the apparent intensity of a light bulb. In the case of the light bulb dimmer control, there are two factors which keep the human visual system from observing flicker. The first is the integration of the human eye (as discussed previously) and the second is the integrating nature of the bulb itself (bulb intensity changes are relatively slowly compared to the 60 Hz line frequency).

The term CFF (Critical Flicker Frequency) is the frequency below which humans can perceive "flicker". The term, "flicker," is typically defined as any change in display intensity over time. Flicker may be an overall "beating" or "pulsing," or it may be a "jittezing" or "motion" (like a movie marquee). The human visual system is more sensitive to flicker in the middle brightness levels. The response time of the display itself also has a major impact on the CFF. CRTs with slow phosphors have a lower CFF than fast phosphor CRTS.

A common temporal technique is pulse width modulation (PWM) of which the room light dimmer is a good example. The 60 Hz AC drive voltage is delivered to the bulb for a percentage of the drive interval. The lower the percentage, the lower the average bulb intensity.

It is possible to use PWM techniques on CRTs by dividing the pixel time into sub-intervals. However, this is generally not done since the times involved for a single pixel is on the order of 20 to 60 nanoseconds. The PWM technique has been used on multiplexed panels, such as electoluminescent (EL) and plasma panels. The horizontal drive period is divided into sub-intervals (usually binary weighted time intervals). The smallest possible sub-interval may be 1-pixel time. The drive electronics required for these displays is more expensive than for the STN LCDs because the drivers must store multiple bits per pixel, i.e., 16 gray levels require 4-bits per pixel of storage. Since an entire ROW is buffered before the row is displayed, the pixel information must be stored in the column drivers. A 16-level driver (requiring 4-bits per pixel) would require 4 times more memory storage than a 2-level driver. PWM techniques as described do not increase flicker because the modulation takes place during a subinterval of the overall display refresh rate, i.e., 60 Hz.

On the other hand, PWM techniques have generally not been employed successfully on STN LCDs because the fast switching of the high voltage drive electronics causes objectionable "noise," or interference, to be induced on other pixels in the row or column.

One additional PWM technique which does not induce flicker is to drive pixels for a portion of tie frame period (the smallest sub-interval is one row time). This technique has been used successfully on AC plasma panels, but, the cost of the drive electronics is increased even higher above the previously described PWM system. Not only must multiple bits per pixel be stored, but, multiple pixel rows must also be stored. This technique could conceivably be used on STN LCDS, but, the cost most likely limits the success of such a display.

The temporal technique which is widely used with STN LCDs is referred to as Frame Rate Cycling (FRC) and also as Frame Rate Duty Cycle (FRDC). This technique uses the frame refresh period as the smallest time interval. But since the time interval involves multiple frames, flicker is the biggest problem with this technique. The human eye is capable of integrating (smoothing) an intensity, but the basic frequency of the displays intensity variations must be above the CFF point. Present STN LCDs generally have a much lower CFF point than a CRT because the LCD response time is long compared to the CRT. Nonetheless, this only helps a certain amount to reduce flicker. Other factors must be considered in order to reduce flicker.

So far temporal integration techniques which employ time-averaging (PWM, FRC) and spatial integration techniques, such as error diffusion and ordered dithering, have been discussed. Another technique used for years on home TV sets to reduce flicker is interlacing, which takes advantage of both temporal and spatial integration features at the same time. In a television, the frame is broken into two 60 Hz fields. During field-1, the odd scanlines are displayed. During field-2, the even scan lines are displayed. The frame period is 30 Hz, well below the CFF for most CRTs. Since "dips" in intensity in a display region are quickly "filled" by the next field update, the human eye is fooled into thinking that the display is being updated at or near the 60 Hz field frequency. If the eye were able to resolve smaller images, this technique would not be nearly as effective. The interlacing technique was not used to help TVs produce gray scales. Instead, interlacing was used to reduce flicker which occurred when the bandwidth of the TV system was limited to a 15.75 kHz horizontal scan rate.

On the other hand, this flicker reduction technique is the basis of the FRC algorithms used to produce gray scales on STN LCD displays. In order to produce more than two levels of gray shade, more than one frame time is required. Two frame times will yield 3-shades (0, 100%, 50%). The new shade of 50% is the result of the pixel being "on" during FIELD-1 and "off" during FIELD-2. An LCD is not actually interlaced in the even/odd scan lines like the CRT example. Rather, a pixel is DRIVEN to the on state during the first FRAME CYCLE and to the off state in the second FRAME CYCLE. If all pixels of the display are cycling at this rate, then a 30 Hz flicker results. To overcome this, the even lines are driven ON for Field-1, OFF for Field-2 and the odd lines are be driven OFF during Field-1, ON for Field-2. With the lines 180 degrees out of phase with each other, the 30Hz flicker is essentially canceled out (if the eye cannot easily distinguish the 2-lines).

The term, "phase," is often used in FRC algorithm discussions. A 2-frame FRC algorithm is said to have 2-phases to define the temporal sequence. PHASE-1 is "on" during frame-1 and "off" during frame-2, while PHASE-2 is 180 degrees out of phase, or "off" during frame-1 and "on" during frame-2.

In computer graphics horizontal lines are often drawn on the display. If the line has a 50% gray value and the line is only one row thick, then the line flickers at the 30 Hz rate. To avoid this, a technique commonly used in many FRC algorithms is to interlace the rows AND columns. In this method a 2×2 matrix of pixels is used. Diagonally adjacent pairs of pixels observe PHASE-1 and the other pair of diagonally adjacent pixels observe PHASE-2. The flicker produced by the one-horizontal-line example described above is avoided since horizontally adjacent pixel pairs are 180 degrees out of phase. Vertical lines (also encountered often in computer graphics) also contain vertically adjacent pixels of opposite phase. Only a checkerboard pattern vulnerable to flicker under this 2×2 matrix technique.

Almost all FRC algorithms use a square matrix of pixels in order to avoid the flicker problems described above and to compact the phases into the smallest area possible and thereby take advantage of the spatial resolution limits of the human visual system of course, it is often desired to provide more than 3 gray shades (using 2-frames).

By using 3 frames for the gray scale period, 4 shades may be produced:

0/3=0%

1/3=33%

2/3=66%

3/3=100%

Notice that in this example the 50% shade is missing. If the 50% shade were to be used, then 5 shades are produced. However, the intensity steps between each gray shade are not be equal. However, 5 shades are still better than 4 shades. of course, 5 equally spaced shades produce better looking images than 5 unequally spaced shades. The 3-frame example requires 3 phases for each shade. For example, gray shade 1/3 has the phases spaced 120 degrees apart from each other as shown in FIG. 1. The table in FIG. 2 shows, for instance, that in 8-frame periods it is possible to produce 23 unique shades (adding all the unique shade numbers together).

By combining the basic FRC technique along with the dithering (spatial) techniques, it is possible to extend the number of gray scales to a level beyond those produced by FRC alone even further. It has been demonstrated that a base of 16 gray shades can be extended to 32 or 64 (or beyond) gray shades by using such dithering techniques. However, as mentioned earlier, these images tend to look grainy compared to comparable shades generated by other techniques. It has also been demonstrated that as many as 17 frames have been successfully used to produce 18 shades using the FRC technique with acceptable flicker display quality. It has also been demonstrated that 64 FRC gray shades can be produced with as few as 16 frames with the disadvantage of that the resulting gray shades are not perfectly linear.

Thus an effective technique of providing 64, or more, FRC-generated linear gray shades free of flicker has not been set forth. The present invention solves this problem. Furthermore, the present invention may be easily adapted for color displays.

SUMMARY OF THE INVENTION

The present invention provides for an improved method for generating gray scale levels for pixels in a display. A matrix of adjacent pixels in rows and columns in the display and a phase value is associated with each of the pixels for a selected gray scale level for the pixel. The phase values times ON/OFF signals at the pixel in a frame time period for the display. The improvement in this method comprises the step of multiplying the phase values of the matrix by a predetermined amount for reordering the phase values with the pixels in the matrix, the predetermined amount selected in response to the selected gray scale for the pixel whereby flicker is substantially reduced and gray scale levels are substantially linearized for the display.

Another improvement in the method comprises the steps of associating the phase values with the pixels such that a minimal number of ordered phase values is associated with pixels in all rows and columns of the matrix. This also reduces flicker substantially and linearizes the gray scale levels the display.

BRIEF DESCRIPTION OF THE DRAWINGS

FIG. 1 is a table illustrating the production of gray scale level 1/3 with three frames, as known in the prior art;

FIG. 2 is a table illustrating the number of unique gray scale levels in eight frame periods, as known in the prior art;

FIG. 3 is a table of phases for the production of gray scale level 1/4 in a 2×2 matrix; as known in the prior art;

FIG. 4 is an exemplary 4×4 matrix of phase values according to the present invention;

FIG. 5 is a table of predetermined values for the operation of multiplication, addition and rotation of rows and columns for generation of 8×8 matrices from the 4×4 matrix of FIG. 4 in accordance with the present invention;

FIG. 6A is a first one of the 8×8 matrices generated from the matrix of FIG. 4; FIG. 6B is a second one of the 8×8 matrices generated from the matrix of FIG. 4; FIG. 6C is a third one of the 8×8 matrices generated from the matrix of FIG. 4;

FIG. 7 is an empirically generated 8×8 matrix for the gray scale level 32/64 according to the present invention;

FIG. 9 is a selection table of the matrices of FIGS. 6A–6C and 7, and of multiplier values for phase values of the selected matrices for each gray scale level according to the present invention;

FIG. 10 lists the operational logic equations for the Grayscale Mapper block shown in FIG. 8;

FIG. 11 lists the operational logic equations for the Matrix Decoder shown in FIG. 8;

FIG. 12 lists the operational logic equations for the Multiplier Decoder shown in FIG. 8;

FIG. 13 lists the On/Off sequences of each gray scale level 0/64–32/64 generated by the Brightness Generator of FIG. 8;

DETAILED DESCRIPTION OF PREFERRED EMBODIMENT(S)

Figure 8:
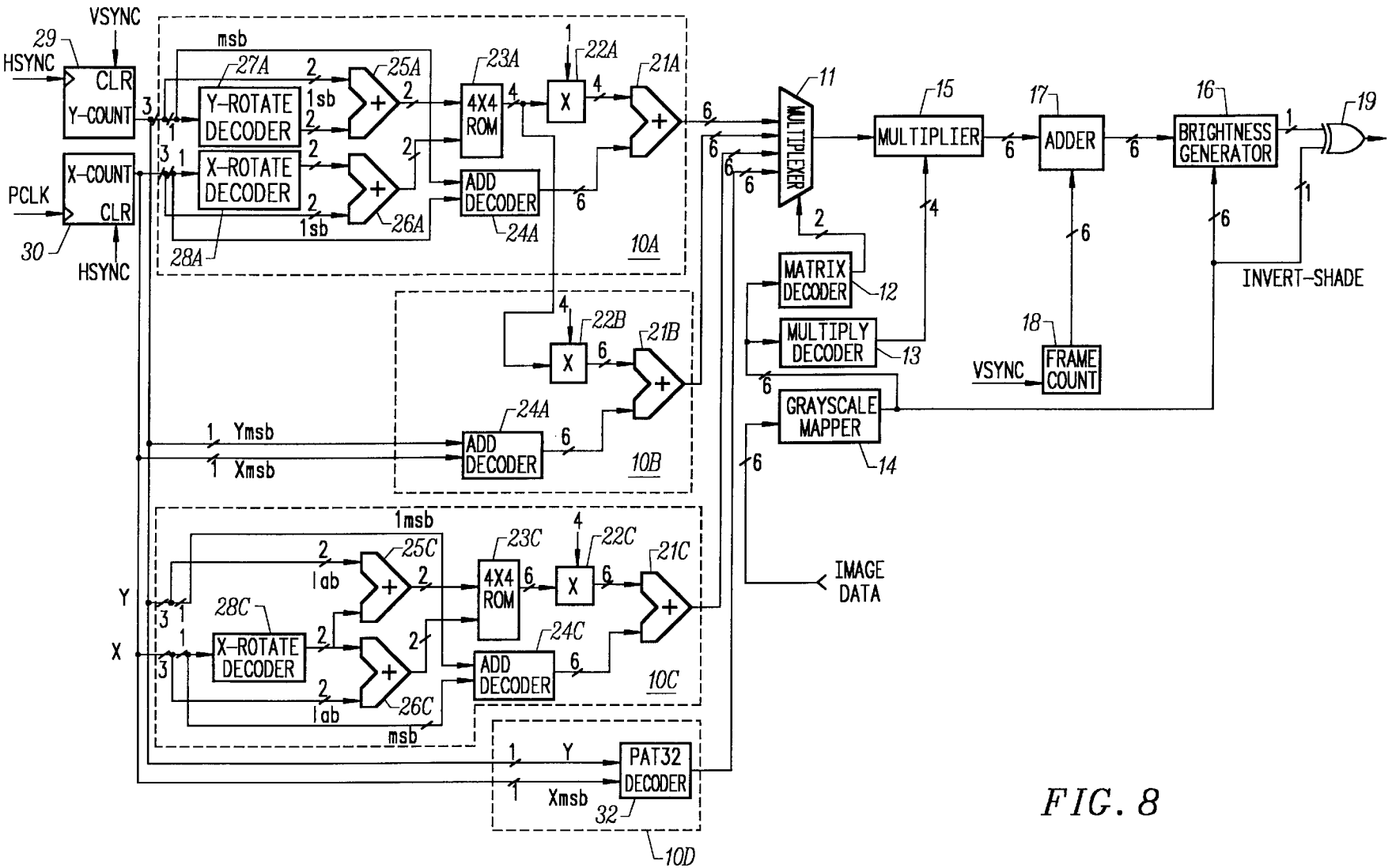
FIG. 8 illustrates a circuit implementation to generate gray scale levels according to the present invention.

The description below explains the methodology of the present invention and the circuit elements to implement. Though the description is made to achieve a particular number of gray scales on an LCD display, i.e., 64 gray scale levels, it should be understood that the present invention may be applied to achieve a higher, or lower, number of linear gray scale levels also.

Gray Scale Level Methodology

In most FRC algorithms a square matrix of pixels is chosen. This yields the shortest length and width in the display which tends to maximize performance based upon the limited resolution of the human eye. Another factor in a matrix choice is that the number of pixels within the matrix must contain all of the possible phases of the gray scale levels. For example, a 4-frame gray scale algorithm (producing 5-shades) requires a minimum 2×2 pixel matrix to accommodate all 4-phases of each brightness waveform. Square matrices of 2×2, 3×3, 4×4, 5×5, 6×6, 7×7, 8×8 etc. accommodate 4, 9, 16, 25, 36, 64-frame algorithms respectively. For algorithms such as 17-frames, there is no square-root integer number. An algorithm such as this normally occupies a square matrix, but with each side of the square equalling the number of frames (17). The 64-frame algorithm described in the present invention utilizes matrix size of 8×8.

The assignment of phases to the pixel locations in the matrix is important to a successful FRC gray scale algorithm. Quite often a set of phases which work well for one gray scale does not work well for another gray scale. Potentially a separate set of phases may be required for each gray scale level. In the case of 64 gray shades, up to 33 sets of phases may be required. (As explained below, a set of phases of one gray scale may be inverted for a complementary gray scale.) This number of sets is about four times the potential number of sets required for a 16-shade algorithm. Not only is the low frequency flicker components of the 64-frame algorithm a major design hurdle, but the potential fourfold increase in hardware logic must be minimized in order to keep the cost of the implementation to a reasonable level. A unique approach taken in the present invention is to construct large matrices from successful smaller matrices. By this method successful larger matrices are easier to determine and the smaller matrices can be used to build the larger matrices in a manner which minimizes logic.

A 2×2 matrix can contain four phases suitable for a 4-frame (5-shade) algorithm. The phases for shade 1/4 in a 2×2 matrix are shown in FIG. 3. In a proper placement of phases in a matrix, all the rows and columns in the matrix "covered" in the shortest period of time. That is, if one follows the pixels called for by the order of the phases, the pixels will address all the rows and columns in the matrix in a minimum number of phases. This feature is particularly important for STN LCD devices because these displays are prone to crosstalk, also known as shadowing, ghosting or streaking. Crosstalk occurs in STN displays because the pixels in the matrix are essentially capacitors which are not totally isolated from each other. When a pixel in a given row/column is energized, other pixels in the same row/column are also affected. By covering all rows and column in the shortest period of time, the resultant gray shade appears more uniform with less flicker.

Placement of Phase-0 in position (0,0) of the 2×2 matrix of FIG. 3 "covers" all of the pixels in Row-0 and Column-0 when Frame-0 occurs. In Frame-1, Phase-1 becomes active. Placing Phase-1 in position (0,1) or (1,0) again covers Row-0 and Col-0 respectively. A better choice is to place Phase-1 in pixel position (1,1). At this point in time, all rows and columns of the 2×2 matrix are covered after only two frames. It is easy to extrapolate that a 4×4 matrix may be covered in 4 frames and an 8×8 matrix in 8 frames.

The last two pixels, (0,1) and (1,0), of the 2×2 matrix may be filled either by Phase-2, followed by Phase-3, or Phase-3, followed by Phase-2, respectively. The impact on the gray shade quality is about the same.

With an assumed phase placement in a 2×2 matrix of:

0, 2

3, 1 an exemplary 4×4 matrix may be constructed.

As stated above, all the rows and columns in a 4×4 matrix may be covered in four frames. An obvious choice is (0,0), (1,1), (2,2), (3,3) for the first four phases. However, this leads to a moving diagonal line from upper left to lower right corner of the matrix. This straight line motion should be avoided because it does not produce a smoothly shaded gray scale. Rather, the 4×4 matrix is divided into four quadrants, each similar to the 2×2 matrix. Each successive phase covers each quadrant in the shortest possible time. The particular sequence chosen (others are within the scope of this invention) is upper-left, lower-left, lower-right, upper-right quadrants. Using the previous 2×2 matrix of:

0, 2

3, 1

Phase-1 is placed in the lower-left quadrant, and within that quadrant Phase-1 is in position (1,1), as in the case with the 2×2 matrix. Phase-2 is then placed in the lower-right quadrant and within that 2×2 matrix, Phase-2 is placed in location (0,1), as in the 2×2 matrix. In the upper-right quadrant, the 2×2 matrix position (1,0) is filled by Phase-3.

Phase-4 starts the process again in the Upper-Left quadrant. It occupies the position below Phase-0 (following the same rotation as the quadrants).

The process continues in this manner until all 16-positions are filled and results in the 4×4 base matrix illustrated in FIG. 4. This basic 4×4 matrix conforms to the rule of covering all rows and columns in the minimum time during frames 0–3 and also during subsequent frames. This 4×4 matrix is then used to create three 8×8 matrices for the 64-frame algorithm.

The previous 4×4 matrix can be generated algorithmically in the following manner: An original, starting 2×2 matrix of:

0, 3

1, 2 in the upper left quadrant is multiplied by 4 to obtain:

0, 12

4, 8

In the lower left quadrant the original 2×2 matrix is multiplied by 4, and 1 is added. Then the rows and columns are rotated by a value of 1 to obtain:

9, 5

13, 1

In the lower right quadrant the original 2×2 matrix is multiplied by 4, and 2 is added. The rows are then rotated by 0 and columns rotated by a value of 1 to obtain:

14, 2

10, 6

In the upper right quadrant the original 2×2 matrix is multiplied by 4, and 3 is added. Then the rows are rotated by 1 and columns rotated by a value of 0 to obtain:

7, 11

3, 15

This basic algorithm of multiplication, addition and rotation is carried forward to the generation of 8×8 matrices. Three 8×8 matrices are derived from the 4×4 matrix described above. Once again the 8×8 matrix may be considered as containing four quadrants of 4×4 submatrices. The variables of multiplication, addition and rotation are different for each 8×8 matrix (designated A,B,C) and are shown in a table shown in FIG. 5.

The values for the three matrices (A,B,C) derived from the 4×4 matrix and using the factors from the table of FIG. 5 are shown in FIGS. 6A–6C. For example, in the first matrix the original 4×4 matrix appears in the upper-left quadrant because the Multiplication factor is 1 and the Addition value for this quadrant is 0.

There is one additional matrix D shown in FIG. 7 for the gray scale 32/64, which has only 2-phases (0 and 1). The matrix shown in FIG. 7 has two benefits. First, a "checkerboard" dither pattern (encountered often in graphics images) does not cause any flicker. Secondly, if a checkerboard pattern of single ones and zeros were used, this gray shade creates excessive crosstalk as the height of a gray bar pattern grows. That is, in each column the pattern of FIG. 7 skips between ones and zeros less often than every row. This crosstalk typically causes the shade to grow dimmer as the height grows to cause a problem in the linearity of intensity. By alternating the phases less often as shown in FIG. 7, the shade is relatively insensitive to the size of the gray bar. Gray scale linearity is preserved.

Circuit Implementation of the Present Invention

A circuit for executing an FRC algorithm with the 8×8 phase matrices for gray scale levels for individual pixels in an LCD display is illustrated in FIG. 8. Generally stated, four circuit units 10A–10D generate the assignment of phases in an 8×8 matrix, as described above. Responsive to the gray scale level, termed Image Data in FIG. 8, of a pixel, a multiplexer 11 selects the phase value from the appropriate unit 10A–10D. The phase value is multiplied by predetermined value by a multiplier 15 and added to the particular frame count by an adder 17. A Brightness Generator block 16 combines a basic ON/OFF temporal sequence of the gray scale level of the display pixel with the phase value-modified frame count from the adder 17. The result determines whether the pixel is ON or OFF at that time.

Finally, an EXCLUSIVE-OR logic gate 19 operates as an inverter for gray scale levels greater than 31/64. This saves circuitry since the first 32 gray scale levels (0/64 to 31/64) are inverse opposites of levels of gray scale levels, 33/64 to 64/64.

The four circuit units 10A, 10B, 10C and 10D respectively generate the phase values of the Matrices A, B, C and D shown in FIGS. 6A–6C and 7. For the circuit units 10A–10D, the pixel addresses in each 8×8 matrix are generated by an x-counter 30 and y-counter 29. The x-counter 30 is responsive to a pixel clock and is cleared by the horizontal synchronization (HSYNC) signal, which is generated at the end of each sweep across a row of pixels in the display. The y-counter 29 is responsive to the HSYNC signal and is cleared by the vertical synchronization (VSYNC) signal, which is generated at the end of the last pixel in the array, i.e., at the end of the last horizontal sweep in the display.

Each of the counters 29 and 30 has a three-bit output for the pixel address in its corresponding 8×8 matrix. Referring to the table on FIG. 5, it should be noted that row and column rotations are performed depending upon the particular matrix, A, B or C, and in which quadrant the pixel is located. For the Matrix A, the rotation between the rows, y-rotation, is performed by a Y-Rotate Decoder 27A and adder 25A. The Y-address from the counter 29 is sent to the decoder 27A, which generates an output according to the table in FIG. 5. The 2-bit decoder output is received by one input leg of the adder 25A and the second input leg of the adder 25A receives the two least significant bits from the counter 29. Depending upon the output of the decoder 27A, the-two-bit output of the adder 25 rotates the y-address in the matrix in accordance with the instructions of the FIG. 5 table. Similarly the rotation between the columns, x-rotation, is performed by a X-Rotate Decoder 28A and an adder 26A.

The x- and y-rotated addresses are sent to a read-only memory (ROM) 23A, which holds the phase values of the base 4×4 matrix shown in FIG. 4. Stated differently, these addresses "rotate" the phase values of the matrix held in the ROM 23A. Each of the phase values is multiplied by a multiplier 22A by a particular value depending upon the Matrix A. For Matrix A, the multiplier is one.

The product from the multiplier 22A is augmented by a particular value by an adder 21A, which has one input leg connected to the output terminals of the multiplier 22A. The value is predetermined in accordance with the table of FIG. 5. Depending upon quadrant of the pixel address, an Add Decoder 24A responsive to the most significant x and y output bits from the counters 30 and 29, sends the predetermined amount to a second input leg of the adder 21A. The output of the adder 21A is the phase value of one of the pixel locations of one of the 8×8 matrices. An 8×8 matrix of phase values has been constructed from a 4×4 matrix of phase values after multiplication, addition and rotation operations.

The circuit unit 10C is arranged similarly to the circuit unit 10A to perform the multiplication, addition and rotation operations noted in the table of FIG. 5. Since the x and y rotations are identical, only one rotation decoder 28C is used in the circuit unit 10C.

The circuit unit 10B has a smaller number of elements. Matrix B has the same rotation operations as does Matrix A and hence the rotated values from ROM 23A also feeds a multiplier 22B (with a multiplier of four) in the circuit unit 10B. This conserves circuitry.

The circuit unit 10D generates the 8×8 matrix of phase values shown in FIG. 7 for the gray shade level 32/64. The unit 10D has decoder 32, which is responsive to 2 bits, the most significant x bit and the intermediately significant y bit. More precisely, the decoder 32 operates under the logic equation:

$$Pat32=/y1*xx2+y1*/x2$$

where logic operators "/" defines the NOT (the inversion) operator, and "*" the logical AND operation, and "+" the logical OR operation.

The 8×8 matrices generated by the circuit blocks 10A–10D evenly distribute the grayscale "ON" bits over time and space of the matrix. For a grayscale with only 1 "ON" bit (1/64), the ON bit tracks the path around the 8×8 matrix in order. Each quadrant receives an ON bit every fourth frame cycle. But as the number of ON bits increases, e.g., for the gray scale 17/64, the spacing between the ON bits is irregular. During some frame intervals there may not be an equal number of ON bits in each quadrant. In fact, some quadrants may become heavily occupied, while other quadrants are sparsely occupied. This can sometimes cause flicker in the gray scale.

By multiplying each value in the selected 8×8 matrix by some value, the quadrant time occupation may be modified with a much improved gray shade in terms of flicker and uniformity. Multiplier values for the 8×8 matrix have been determined empirically. While lower and higher numbers of bits may be used, four bits have been found sufficient for the multiplier value. The binary output of a 4-bit×6-bit product is 10-bits. Since only the 6 least significant bits are required, the cost of the multiplier is reduced. This multiplication operation successfully produces FRC algorithms at a reasonable cost when the number of gray shades rises beyond 16 levels to 32, 64, and even higher levels.

Along with the proper multiplier value, the proper selection of one of the 8×8 Matrices A, B, C or D must be made for each gray shade level. Again, the selection has been determined empirically. The results are shown in FIG. 9.

To accomplish the selection and multiplication of one of the Matrices A, B, C or D, the output from each of the circuit unit 10A–10D is sent to a multiplexer 11, as shown in FIG. 8. Under selection signals from a Matrix Decoder block 12, the output signals of a particular circuit unit 10A–10D are selected by the multiplexer 11 and the results are multiplied by a Phase Multiplier block 15. Multiplier values are sent to the multiplier 15 from a Multiplier Decoder block 13.

These operations are dependent upon the gray scale level, the Image Data, of the particular pixel to be displayed. Image data in the form of six bits to define one of 64 gray scale levels for a pixel are received by a Grayscale Mapper block 14. The logic equations for one implementation of the block 14 are shown in FIG. 10 with logic operators, "/" defined as NOT(the inversion operator), "*" as logical AND, and "+" as logical OR. In effect, the 6-bit Image Data are reduced to an Invert-Shade bit, explained below, and the 5 least significant bits of image data.

More precisely, for gray scale levels less than 32/64, the block 14 output (MAPPED GRAYSCALE in the FIG. 10 logic equations) is 5 least significant bits of the image data plus 1, except the 0/64 level remains as 0/64. A 1 is added to the 5 bits of image data since the block 14 operates to eliminate one of the gray shade levels, 1/64. 64 gray shades may be generated by 63 frame intervals, but 64 is a full binary number; digital counters can implement a count of 64 much more efficiently than 63. However, since 64 frames yields 65 gray shades, one of the 65 shades can be discarded. The resultant linearity loss at the gray shade level boundaries, i.e., near the shades 0/64 and 64/64, is negligible, compared to a linearity loss if the shade discarded is near the middle of the display range, say, gray shade 32/64. Since the boundary shades 0/64 and 64/64 are the most stable and easy to produce, the elimination choice becomes either 1/64 or 63/64. Shade 1/64 is eliminated because a display is often adjusted to illuminate the dim shades. Since the dim 1/64 shade has the highest flicker potential, the Grayscale Mapper block 14 skips the gray scale 1/64.

For gray scale levels 32/64 to 63/64, the block 14 output is almost the same as the 5 least significant bits of image data. The block 14 also generates the Invert-Shade bit which lessens the amount of logic to generate 64 gray shade levels by one-half. Since the first 32 gray shades (0/64 to 31/64) are inverse opposites of shades 64/64 to 33/64 respectively, only shades 0/64–32/64 need to be generated. The second set of shades, from 33/64 to 64/64, are simple inversions of the output signals derived from the first set of gray scales. To take advantage of this simplification, a Invert-Shade command bit is generated whenever the input shade level is 32/64 or above (inverting shade 32/64 itself has no logical consequences). Also, since the Brightness Generator block 16, described below, produces shades 0/64 to 32/64, the Grayscale Mapper block 14 also produces an inverted address when the input gray scale level is greater than 31/64.

Responsive to the output from the Grayscale Mapper block 14, two multiplexer selection bits are generated by the Matrix Decoder block 12. The selection bits direct the four-to-one multiplexer 11 to select the proper four 8×8 Matrices A–D from the circuit units 10A–10D to match the input gray scale level. The equations for the decoder block 12 are listed in FIG. 11. Of course, this decode function could be implemented in a memory, such as a ROM, or other similar logic.

Also responsive to the output from the Grayscale Mapper block 14, the Multiplier Decoder block 13 generates four-bit multiplier values for the Phase Multiplier block 15 to multiply the selected 8×8 matrix phase values from the output of the multiplexer 11. The decoder block 13 is implemented in accordance with the logic equations listed in FIG. 12. Of course, this function of the decoder block 13 may be also implemented in a memory, such as in a ROM, or other similar logic.

The 6-bit output generated by the Phase Multiplier block 15 represents the phase value of a pixel having its gray scale value, the Image Data of FIG. 8, at the input terminals of the Grayscale Mapper block 14. The 6-bit output is added to the 6-bit output of a frame counter 18. The frame counter 18 is a simple 6-bit free-running counter clocked by the display's VERTICAL SYNC pulse (VSYNC) or its equivalent. Addition is performed by an adder 17, which has a 6-bit output. From the adder 17, the selected and multiplied phase value output is received by the Brightness Generator block 16. Thus, for any given phase of a gray scale, all possible 64 bits of the brightness generator 16 are accessed over 64 frames.

The Brightness Generator block 16 generates the gray scale waveforms in order to minimize flicker by spacing the ON bits as evenly as possible over 64 frames. For example, gray scale level 17/64 may be simply a signal which is active for 17 frames and then inactive for the remaining 47 of 64 frames. However, this is not effective in terms of avoiding flicker. By spacing the ON bits as evenly as possible throughout the 64 frames, the integrating nature of the LCD fluid, as well as the temporal integration feature of the human eye, is exploited. For gray shade 17/64, the ideal spacing is one ON bit out of every 3.7647058 frames (64 divided by 17). Since the minimum time slice in the FRC technique is one frame time, only an integer number can be handled. Thus most of the time the ON bit occurs every 4 frames. Every fourth cycle the ON bit occurs at the third frame.

The ON/OFF sequences for gray scale levels 0/64–32/64 are listed in FIG. 13. It should be noted that only the last digit of the counted frame is used on the top row of FIG. 13. Levels 33/64–63/64 are the logical complements of levels 31/64–0/64 respectively. These bit sequences can either be stored in a ROM table or other equivalent logic, or, the bits can be calculated.

To determine the frame location of the ON bits, an error accumulation technique can used in the block 16. Data is quantized to an integer value. If the data is less than 0.5, then it is quantized to 0. Otherwise, it is quantized to 1. In either case, an "error" is generated unless, of course, the data really is 0 or 1. When the error switches from a positive error to a negative error, or vice versa, the ON bit locations have been determined. This requires the tracking of prior history. Keeping track of prior history for 32 gray scale levels is complex and expensive. Instead, a multiplier and a subtractor may be used to generate the vlaue at any given point in time. The multiplier calculates the CURRENT FRAME values and the substractor provides the prior history values. Computationally error may defined as:

ERROR(FRAME)=(GRAYSCALE/64*FRAME)−INT(GRAYSCALE/64*FRAME)

ERROR(FRAME−1)=(GRAYSCALE/64*FRAME−1)−INT(GRAYSCALE/64*FRAME-1)

For example, grayscale 3/64 has its first "on" bit on FRAME=11. From the above equations:

ERROR(11)=(3/64*11)−INT(3/64 *11)=0.515625-1=−0.48437

ERROR(10)=(3/64*10)−INT(3/64 *10)=0.46875-0=+0.46875

The error switches sign between frames 10 and 11 and thus, the bit for frame-11 is ON. Of course, this floating point arithmetic can be avoided simply by multiplying by 64. The INT function (which looks for value ≧0.5) is replaced by 0.5*64=32. Essentially this is a test to see if bit 5 of the multiplication is SET.

The equations below follow:

IF {(GRAYSCALE∗FRAME)>32 = TRUE}
AND
{(GRAYSCALE∗(FRAME − 1))>32 = FALSE}
THEN
BIT IS "ON"
ELSE
BIT IS "OFF"

The situation when FRAME=0 is treated as a special case. In this case FRAME-1 will still be 0. The equation can be again simplified to remove one of the multiplications as follows:

CURRENT = (GRAYSCALE*FRAME)
PREVIOUS = (CURRENT-GRAYSCALE)
IF {CURRENT>32 = TRUE}
AND
{PREVIOUS>32 = FALSE}
THEN
BIT IS "ON"
ELSE
BIT IS "OFF"

The subtraction in digital logic involves two's complement arithmetic. In order to avoid the extra inversions required, one can simply reverse the definitions of current and previous frames and perform an addition instead:

PREVIOUS = (GRAYSCALE*FRAME)
CURRENT = (PREVIOUS+GRAYSCALE)
IF {CURRENT>32 = TRUE}
AND
{PREVIOUS>32 = FALSE}
THEN
BIT IS "ON"
ELSE

-continued

BIT IS "OFF"

This simply left-rotates all of the waveforms in FIG. 13, but, the basic on/off sequencing remains intact.

Figure 14:
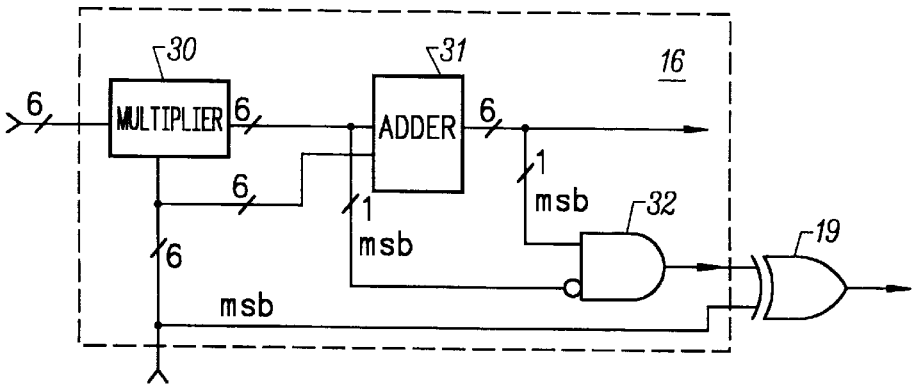
FIG. 14 is a block diagram illustrating the brightness generator block of the FIG. 8 circuit.

FIG. 14 is a block diagram of the Brightness Generator block 16 which performs the sequencing of the OFF and ON signals, as described above. It should be noted that the FRAME values are the 6-bit signals from the adder 17. Thus FRAME values represent the sum of phase values from the multiplier 15 and actual frame values from the counter 18.

In the Brightness Generator block 16 a multiplier 30, which multiples the FRAME values and the gray scale values from the Grayscale Mapper block 14, generates the PREVIOUS values. An adder 31 generates the CURRENT values from the sum of the PREVIOUS values and the gray scale values. An AND logic gate 32 receives the most significant bit (msb), bit 5, of the CURRENT values and the inversion of the msb, bit 5, of PREVIOUS values to determine the conditions, CURRENT>32=TRUE and PREVIOUS>32=FALSE. Both conditions must be true to set the logic gate output to be "1" or ON.

As described previously, the final determination to set pixel bit ON or OFF is performed by the EXCLUSIVE-OR logic gate 19 which receives the output of the AND logic gate 32 and the Invert-Shade bit from the Grayscale Mapper block 14 for the pixel. The logic gate 19 performs the inversion of signals for gray scales greater than 32/64.

It should be noted that the described calculation of the ON/OFF sequences for gray scales can be implemented in logic circuits with a savings in integrated circuit area compared to implementation in memory, as has been done in previous LCD controllers. For example, a 16 gray scale algorithm requires 16 frames. In a ROM this requires 8, one-half the total number of gray scales, locations, each holding 16 bits. As the number of gray scales is increased, the memory storage requirements are geometrically increased. Thus the logic circuit implementation becomes increasingly advantageous as the number of gray scales, and the frame rates, are increased.

Dual Scan Displays

Dual scan displays, which have been described previously with respect to many present STN LCD panels, are divided into a top and bottom panels and are scanned simultaneously from upper panel and lower panel data streams. To accomplish this, one can fetch data from separate memories and duplicate all other data paths, including the gray scale generation circuitry. Clearly this is expensive.

A much more cost-efficient way is to scan the data as if the display were a single section. Multiple bits per pixel image data are fetched once per frame. As the data is fetched, it is converted into 1-bit per pixel gray scaled data (ON or OFF as determined by the Brightness Generator block 16). At this point, the data for the next frame is pre-calculated and stored as 1 -bit per pixel in an unused portion of the memory (or a separate memory) such that when the image reaches the middle of the display (first line of the bottom portion of the LCD panel, data which was pre-stored for Frame-2 is sent to refresh the top half of the display while the bottom half is converted from multiple bits per pixel image data to 1-bit per pixel gray scaled data. The next frame data for the lower panel is precalculated and stored in the same unused area of memory (which was just vacated by the refresh operation of the top panel) in a repeating READ-MODIFY-WRITE cycle.

Predicting the future is just adding an additional term to the equation:

```
PREVIOUS = (GRAYSCALE*FRAME)
CURRENT = (PREVIOUS+GRAYSCALE)
NEXT = (CURRENT+GRAYSCALE)
IF      {CURRENT>32 = TRUE}
        AND
        {PREVIOUS>32 = FALSE}
        THEN
        CURRENT-BIT IS "ON"
        ELSE
        CURRENT-BIT IS "OFF"
IF      {NEXT>32 = TRUE}
        AND
        {CURRENT>32 = FALSE}
        THEN
        NEXT-BIT IS "ON"
        ELSE
        NEXT-BIT IS "OFF"
```

Figure 15:
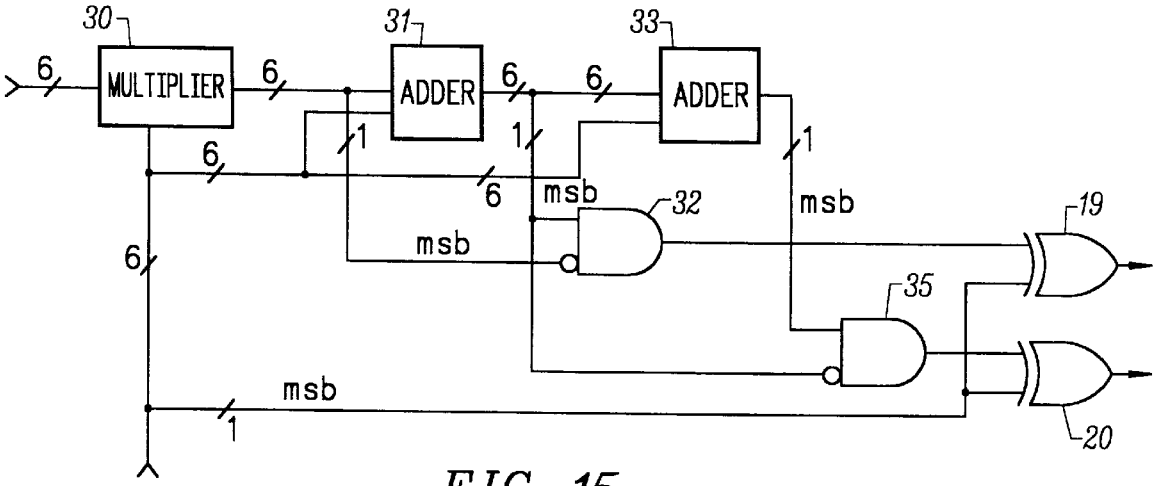
FIG. 15 is a block diagram illustrating an alternative embodiment of the FIG. 14 circuit.

FIG. 15 illustrates the Brightness Generator block 16 which has been modified to perform the described functions. Added to the previously described elements, the block 19 has an adder 33 which combines the 6 bits of the CURRENT values from the adder 31 with the 6 bits of the gray scale values. The sum of the adder 33 represent the NEXT values described above. However, only the msb, bit 5, of the sum is used, as the input to an AND logic gate 35. The logic gate also receives the inverted msb of the CURRENT values from the adder 31. The output of the logic gate 35 represents the determination of the above conditions, NEXT>32=TRUE and CURRENT>32=FALSE, for the NEXT-BIT. This output is sent to an additional EXCLUSIVE-OR logic gate 20, which also receives the msb of the gray scale bits, to invert the output bits for the gray scale levels, 33/64 to 63/64. The output of the logic gate 20 is sent to a memory for the dual scan operation.

Implementation for Color Displays

Finally, the present invention is easily implemented for color displays. In general, color LCDs are simply monochrome LCDs with 3 times more horizontal pixels per row and a color filter for the component colors, red (R), green (G), blue (B), placed over the top of the display. Each R/G/B pixel must be driven independently because at any given time the image data may require different shades for each component color. The gray scale generation logic circuitry must be tripled. Usually, there is very little common circuitry shared between the R/G/B grayscale circuits, except the x- and y-counters.

Figure 16:
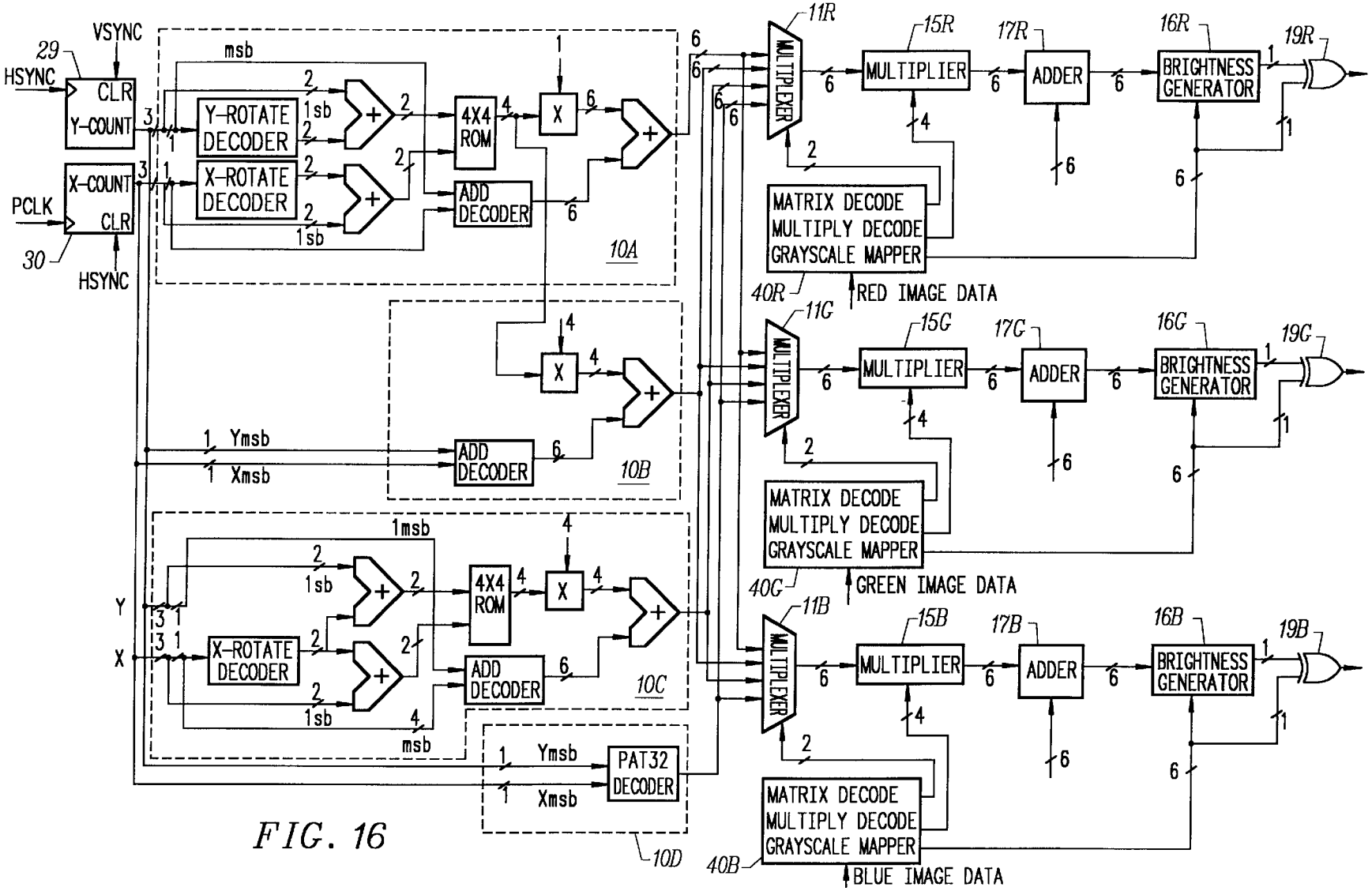
FIG. 16 illustrates a circuit implementation to generate gray scale levels for a color display according to the present invention.

In the present invention, as illustrated in FIG. 16, the generation of the four 8×8 matrices is performed independently of the image data and all of the matrices share common x-and y-counter values. The 8×8 matrix generation logic blocks 10A–10D are implemented only once in a color LCD controller integrated circuit. This saves a significant amount of logic circuitry. However, the circuitry from this point onward must indeed be triplicated for each of the three colors, as shown in FIG. 16. It should be noted that, for the sake of convenience, the Matrix Decoder block 12, Multiplier Decoder block 13 and Grayscale Mapper block 14 in FIG. 8 have been replaced in the drawing by a single block 40R, 40G and 40B for each of the colors. Each of the other previously described elements retain their previous reference number with the suffixes, R, G, and B for red, green and blue colors.

Alternatively, if the gray scale level generation circuitry is fast enough, the circuitry need not be triplicated. A single, high-speed circuit may be used to determine the red, green and blue color intensity levels sequentially and the resulting R/G/B levels can be displayed at the normal speed.

While the above is a complete description of the preferred embodiments of the present invention, various alternatives, modifications and equivalents may be used. It should be evident that the present invention is equally applicable by making appropriate modifications to the embodiment described above. For example, logic circuits are used in much of the circuit blocks for generating the phase values of the 8×8 matrices. Memory tables, such as in ROMs, could be used in place of these logic circuits with the consequent increase in space occupied by the memory circuits on the integrated circuit substrate. Therefore, the above description should not be taken as limiting the scope of invention which is defined by the metes and bounds of the appended claims.

What is claimed is:

1. In an improved method for generating gray scale levels for pixels in a display, said method including the step of defining a first matrix of adjacent pixels in rows and columns in said display and associating a phase value with each of said pixels for a selected gray scale level for said pixels, said phase values timing ON/OFF signals at said pixel in a frame time period for said display, the improvement comprising generating said first matrix from a second pixel matrix, said second matrix having dimensions smaller than said first matrix;

associating the phase values with pixels in said second matrix such that a minimal number of ordered phase values is associated with pixels in all rows and columns of said second matrix, and multiplying said phase values of said first matrix by a predetermined amount for reordering said phase values with said pixels in said matrix, said predetermined amount selected in response to said selected gray scale for said pixels;

whereby flicker is substantially reduced and gray scale levels are substantially linearized for said display.

2. The improved method of claim 1 wherein said second matrix is divisible into quadrants, and said phase values are ordered such that pixels associated with said phase values cycle through each quadrant from a starting quadrant before returning to said starting quadrant.

3. The improved method of claim 2 wherein said second matrix comprises 4×4 pixels and said minimal number of ordered phase values is four.

4. The improved method of claim 1 wherein said selected gray scale level comprises a brightness level for a color in a color display.

5. In an improved method for generating gray scale levels for pixels in a display, said method including the step of defining a first matrix of adjacent pixels in rows and columns in said display and associating a phase value with each of said pixels for a selected gray scale level for said pixels, said phase values timing ON/OFF signals at said pixel in a frame time period for said display, the improvement comprising generating said first matrix from a second pixel matrix;

associating said phase values with said pixels of said second matrix such that a minimal number of ordered phase values is associated with pixels in all rows and columns of said second matrix;

multiplying said phase values of said first matrix by a predetermined amount for reordering said phase values with said pixels in said matrix, said predetermined amount selected in response to said selected tray scale for said pixels;

selecting one of a plurality of first matrices responsive to said selected gray scale whereby flicker is substantially reduced and gray scale levels are substantially linearized for said display.

6. The improved method of claim 5 wherein second matrix is divisible into quadrants, and said phase values are ordered such that pixels associated with said phase values cycle through each quadrant from a starting quadrant before returning to said starting quadrant.

7. The improved method of claim 6 wherein said second matrix comprises 4×4 pixels and said minimal number of ordered phase values is four.

8. In an improved method for generating gray scale levels for pixels in a display, said method including the step of defining a first matrix of adjacent pixels in rows and columns in said display and associating a phase value with each of said pixels for a selected gray scale level for said pixels, said phase values timing ON/OFF signals at said pixel in a frame time period for said display, the improvement comprising selecting a first matrix responsive to gray scale level 32/64 out of 64 gray scale levels, each column of said first matrix having phases alternating at a frequency lower than every row;

multiplying said phase values of said first matrix by a predetermined amount for reordering said phase values with said pixels in said matrix, said predetermined amount selected in response to said selected gray scale for said pixels;

whereby flicker is substantially reduced and gray scale levels are substantially linearized for said display.

9. The improved method of claim 8 wherein said first matrix responsive to gray scale level 32/64 out of 64 gray scale levels, comprises the following:

| | | | | | | | |
|---|---|---|---|---|---|---|---|
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0 |
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0. |

10. In a improved method for generating gray scale levels for pixels in a display, said method defining a first matrix of adjacent pixels in rows and columns in said display and associating a phase value with each of said pixels for a selected gray scale level for said pixels, said phase values timing ON/OFF signals at said pixel in a frame time period for said display, the improvement comprising generating said first matrix from a second matrix of associated phase values, said second matrix having dimensions smaller than said first matrix; and associating phase values with said pixels in said second matrix such that a minimal number of ordered phase values is associated with pixels in all rows and columns of said second matrix;

whereby flicker is substantially reduced and gray scale levels are substantially linearized for said display.

11. The improved method of claim 10 wherein said second matrix is divisible into quadrants, and said phase values are ordered such that pixels associated with said phase values cycle through each quadrant from a starting quadrant before returning to said starting quadrant.

12. The improved method of claim 11 wherein said second matrix comprises 4×4 pixels and said minimal number of ordered phase values is four.

13. The improved method of claim 10 wherein said defining step further comprises selecting one of a plurality of first matrices responsive to said selected gray scale.

14. The improved method of claim 10 wherein said first matrix defining step comprising forming quadrants of said first matrix from a second matrix having dimensions smaller than said first matrix.

15. The improved method of claim 14 wherein each quadrant of said first matrix is formed by said second matrix by the steps of:

defining said second matrix with preselected phase values, said phase values associated with pixels of said second matrix such that a minimal number of ordered phase values is associated with pixels in all rows and columns of said second matrix;

multiplying said phase values of said second matrix by a first predetermined value, said first predetermined value selected in response to said quadrant of said first matrix;

adding to said phase values of said second matrix a second predetermined value, said second predetermined value selected in response to said quadrant of said first matrix;

rotating rows of said phase values of said second matrix by a third predetermined value, said third predetermined value selected in response to said quadrant of said first matrix; and rotating columns of said phase values of said third matrix by a fourth predetermined value, slid fourth predetermined value selected in response to sail quadrant of said first matrix.

16. The improved method of claim 15 wherein said first, second, third and fourth predetermined values include 0 and 1.

17. The improved method of claim 15 wherein said first matrix comprises an 8×8 matrix and said second matrix comprises a 4×4 matrix with phase values as follows:

| | | | |
|---|---|---|---|
| 0 | 12 | 7 | 11 |
| 4 | 8 | 3 | 15 |
| 9 | 5 | 14 | 2 |
| 13 | 1 | 10 | 6. |

18. The improved method of claim 10 wherein a plurality of 8×8 first matrices are generated by said second matrix and selecting one of said plurality of 8×8 matrices responsive to said selected gray scale level.

19. The improved method of claim 18 wherein said defining step includes selecting a first matrix responsive to gray scale level 32/64 out of 64 gray scale levels, each column of said first matrix having phases alternating at a frequency lower than every row.

20. The improved method of claim 19 wherein said first matrix responsive to gray scale level 32/64 out of 64 gray scale levels, comprises the following:

| | | | | | | | |
|---|---|---|---|---|---|---|---|
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0 |
| 0 | 0 | 0 | 0 | 1 | 1 | 1 | 1 |
| 0 | 0 | 0 | 0 | 1 | 1 | 1 | 1 |
| 1 | 1 | 1 | 1 | 0 | 0 | 0 | 0 |
| 1 | 1 | 1 | 1 | 0 | 0 | 0 | 0. |

21. The improved method of claim 10 wherein said selected gray scale level comprises a brightness level for a color in a color display.

22. In an integrated circuit for generating gray scale levels for pixels in a display, a circuit for generating phase values for a first matrix of adjacent pixels in said display, a phase value associated with each of said pixels for a selected gray scale level for said pixel, said phase values timing ON/OFF signals at each pixel in a frame time period for said display, said circuit comprising means for generating phase values for said first matrix from a second matrix of phase values, said second matrix having dimensions smaller than said first matrix.

23. The circuit of claim 22 wherein said first matrix is divisible into quadrants formed from said second matrix.

24. The circuit of claim 23 wherein said generating means comprises means for multiplying said phase values of said second matrix by a first predetermined value selected in response to each quadrant of said first matrix;

means for adding to said multiplied phase values of said second matrix a second predetermined value selected in response to each quadrant of said first matrix;

means for rotating rows of said phase values of said second matrix by a third predetermined value selected in response to each quadrant of said first matrix; and means for rotating columns of said phase values of said second matrix by a fourth predetermined value selected in response to each quadrant of said first matrix.

25. The circuit of claim 24 wherein said first matrix comprises 8×8 pixels and said second matrix comprises 4×4 pixels.

26. The circuit of claim 25 wherein said phase values associated with pixels of said second matrix are such that a minimal number of ordered phase values is associated with pixels in all rows and columns of said second matrix.

27. The circuit of claim 26 wherein said second matrix comprises a 4×4 matrix with phase values as follows:

| | | | |
|---|---|---|---|
| 0 | 12 | 7 | 11 |
| 4 | 8 | 3 | 15 |
| 9 | 5 | 14 | 2 |
| 13 | 1 | 10 | 6. |

28. The circuit of claim 24 wherein said first, second, third and fourth predetermined values include 0 and 1.

29. The circuit of claim 22 further comprising means for generating phase values of a plurality of first matrices;

means for selecting one of a plurality of said first matrices responsive to said selected gray scale; and means for multiplying phase values of said selected first matrices by a fifth predetermined value responsive to said selected gray scale.

30. The circuit of claim 22 wherein said selected gray scale level corresponds to a brightness level for a color in a color display.

31. The circuit of claim 30 further comprising means for generating phase values of a plurality of first matrices;

means for selecting one of a plurality of said first matrices responsive to said selected gray scale corresponding to a brightness level for a color; and means for multiplying phase values of said selected first matrices by a fifth predetermined value responsive to said selected gray scale corresponding to a brightness level for a color.

32. The circuit of claim 31 wherein said phase value generating means comprises means for multiplying said phase values of said second matrix by a first predetermined value selected in response to each quadrant of said first matrix;

means for adding to said multiplied phase values of said second matrix a second predetermined value selected in response to each quadrant of said first matrix;

means for rotating rows of said phase values of said second matrix by a third predetermined value selected in response to each quadrant of said first matrix; and means for rotating columns of said phase values of said second matrix by a fourth predetermined value selected in response to each quadrant of said first matrix.

33. The circuit of claim 22 wherein said selected gray scale level comprises a brightness level for a color in a color display.

34. An integrated circuit for generating color intensity levels for pixels in a display, said integrated circuit comprising a circuit for generating phase values for first matrices of adjacent pixels in said display, a phase value associated with each of said pixels for a selected intensity level, said phase values timing ON/OFF signals at each pixel in a frame time period for said display, said circuit generating phase values for said first matrices from second matrices of phase values, said second matrices having dimensions smaller than said first matrices; and a plurality of circuits each circuit connected to said phase values generating circuit and an output terminal to pixels of each component color in said display, each circuit for generating a sequence of ON/OFF signals responsive to a selected intensity of a component color at a selected pixel in said display;

whereby flicker is substantially reduced and intensity levels for each component color are substantially linearized for said display.

35. The integrated circuit of claim 34 wherein said phase values generating circuit further comprises a plurality of circuit blocks, each circuit block generating phase values from one of said first matrices; and a means for selecting phase values of one of said circuit blocks responsive to said selected intensity level.

36. The integrated circuit of claim 35 wherein said phase values selecting means comprises a plurality of multiplexers, each multiplexer connected between one of said circuit blocks and one of said color component circuits.

37. The integrated circuit of claim 35 wherein said phase values generating circuit further comprises means for multiplying said selected phase values by a predetermined amount responsive to said selected intensity level.

38. The integrated circuit of claim 34 wherein said phase values generating circuit forms said first matrices from a second pixel matrix, said second matrix having dimensions smaller than said first matrices, phase values associated with pixels in said second matrix such that a minimal number of ordered phase values is associated with pixels in all rows and columns of said second matrix.

39. The integrated circuit of claim 38 wherein said matrices are 8×8 and said second matrices are 4×4.

40. An integrated circuit for generating gray scale levels for pixels in a display, said integrated circuit comprising a circuit for generating phase values for first matrices of adjacent pixels in said display, a phase value associated with each of said pixels for a selected gray scale level, said phase values timing ON/OFF signals at each pixel in a frame time period for said display, said circuit generating phase values for said first matrices from second matrices of phase values, said second matrices having dimensions smaller than said first matrices; and a circuit connected to said circuit for generating phase values and an output terminal to pixels in said display, for logically generating a sequence of ON/OFF signals responsive to a selected gray scale level at a selected pixel in said display;

whereby flicker is substantially reduced and gray scale levels are substantially linearized for said display.

41. The integrated circuit of claim 40 wherein said sequence generating circuit spaces ON signals as evenly as possible among said OFF bits.

* * * * *